US005918831A

United States Patent [19]

Floyd, Sr. et al.

[11] Patent Number: 5,918,831

[45] Date of Patent: Jul. 6, 1999

[54] HORIZONTAL WIRE FEEDER

[76] Inventors: Donald Lee Floyd, Sr.; Ruth Pauline Floyd, both of 114 S. J St., Lakeview, Oreg. 97630

[21] Appl. No.: 09/040,662

[22] Filed: Mar. 17, 1998

[51] Int. Cl.[6] ..... B65H 16/04; B65H 75/16; B65H 75/12; B65H 49/02

[52] U.S. Cl. ..... 242/597.7; 242/606; 242/608.3; 242/610.1; 242/610.5; 242/129; 242/130.2

[58] Field of Search ..... 242/597.7, 597.5, 242/606, 608.2, 608.3, 608.4, 610.1, 610.5, 613.2, 129, 130.2

[56] References Cited

U.S. PATENT DOCUMENTS 4,063,694 12/1977 Lemin ..... 242/597.7
4,944,472 7/1990 Stahl ..... 242/597.7

*Primary Examiner*—John Q. Nguyen

[57] ABSTRACT

The "Horizontal Wire Feeder" is a device for unreeling Romex NM-B electrical wire 600 Volt w/gr or armored cable 600 Volt w/gr which comes packaged in up to 250' lengths. The device provides a mechanism of pulling from the outer layer of the coil of wire or cable, causing it to come off the coil evenly while "device" rotates horizontally.

3 Claims, 1 Drawing Sheet

HORIZONTAL WIRE FEEDER

CROSS-REFERENCE TO RELATED APPLICATIONS

Not applicable.

STATEMENT REGARDING FEDERALLY SPONSORED OR DEVELOPMENT

Not applicable.

REFERENCE TO A MICROFICHE APPENDIX

Not applicable.

BACKGROUND OF THE INVENTION

The invention relates generally to a device for unreeling Romex NM-B 600 Volt w/gr electrical wire, or armored cable 600 Volt w/gr, from the outer layer of the coil.

Remove it from its' package, and place the coil of wire, or cable, on the device, and pull the end of the wire, or cable, from its' outer layer. This will cause the device to rotate horizontally, with wire, or cable, coming off the coil straight. Thus allowing the wire, or cable, to be pulled evenly, through the holes, which have been drilled in studs, top plates, and ceiling joists, without curling or kinking, when wiring residential and commercial buildings. This will save man hours, and will give a more professional-looking job.

Presently NM-B 600 Volt w/gr electrical wires comes in a coil that is packaged in cellophane, or in a cardboard box.

In "Prior Art" the way to install it in a residential or commercial building, has been to place it on the floor, cut a round hole in the center of the cellophane, or cardboard box, grasp the end of the wire from the center of the coil, and pull. When pulling on the wire, it comes out in curls, and sometimes put kinks in the wire. When this occurs, you must stop, and straighten the wire, before pulling through the holes, which have been drilled in studs, top plates, and ceiling joists. Resulting in more manhours.

The same problem exists when installing armored cable 600 Volt w/gr in commercial and residential buildings.

You would place a coil of cable on the floor, remove the bayling tie wire, which holds the coil together, grasp the end of the cable, from the center of the coil, and pull through the holes, which have been drilled in studs, top plates, and ceiling joists. When pulling the armored cable, it comes out of the coil, in curls, and sometimes puts kinks in it. When this occurs, you must stop and straighten the cable, before pulling it through the drilled holes in studs, top plates, and ceiling joists. Also causing the use of extra manhours.

Another method now being used for Romex NM-B 600 Volt w/gr electrical wire, or armored cable 600 Volt w/gr, when installing it in a residential or commercial building, is to remove from packaging, take the end of the wire, or cable, from outer layer of the coil, and tie it off to some structure, and while holding the coil, vertically in your hands, and walking, unroll it, distributing it to length needed, so that the wire, or cable, will be straight, before starting to install it through the drilled holes in studs, top plates, and ceiling joists. This is a slow method.

With all of these prior methods the problem has been, having to stop and straighten the wire or cable. The invention will eliminate this problem.

BRIEF SUMMARY OF THE INVENTION

The invention provides a means of pulling the Romex NM-B 600 Volt w/gr electrical wire, or armored cable 600 Volt w/gr, which comes packaged in up to 250 ft. lengths, from the outer layer of the coil, as opposed to pulling it from the inner layer, which is presently the common practice, (which results in it coming off the coil in curls and kinks). The invention will keep the wire or cable straight and it will pull evenly through the drilled holes in studs, top plates, and ceiling joists, with no curls or kinks.

It is an object of the invention to provide a more efficient means of installing electrical wire or armored cable in a residence or a commercial building. It is timesaving and accomplishes a more professional looking job.

DETAILED DESCRIPTION OF THE INVENTION

Figure 1:
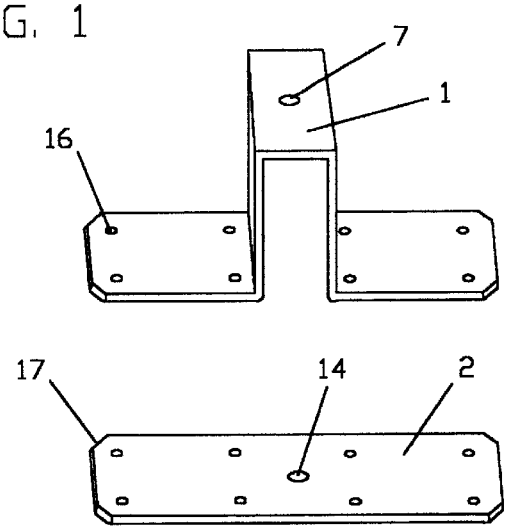
FIG. 1 is a perspective view of the "Horizontal Wire Feeder" frame showing the top and bottom pieces before being attached together.
Figure 3:
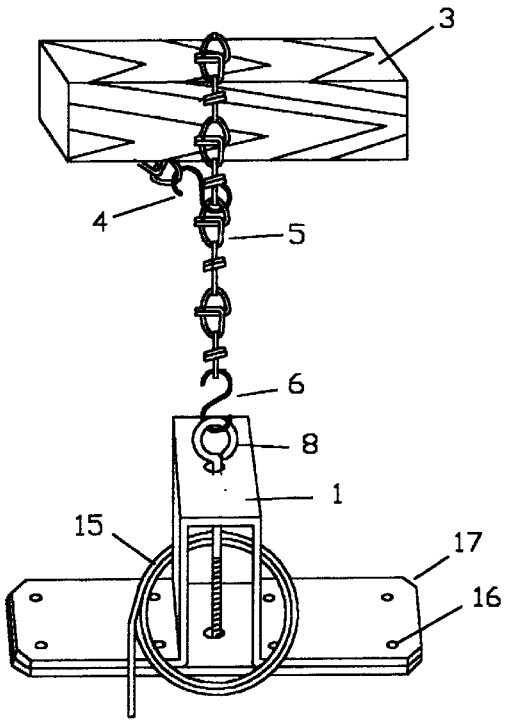
FIG. 3 is also a front elevation view of the assembled "Horizontal Wire Feeder" (holding a coil of electrical wire), including a frame, an S hook, a double loop chain, a second S hook, and an above structure.
Figure 2:
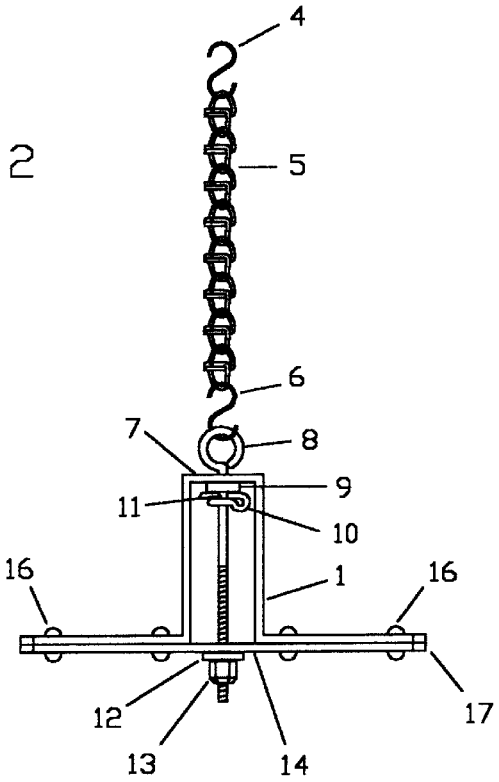
FIG. 2 is a front elevation view of the assembled "Horizontal Wire Feeder" including a frame, an S hook, a double loop chain, and a second S hook.

Referring to FIGS. 1, 2, and 3 an embodiment of the "Horizontal Wire Feeder" is shown. In this embodiment a double loop chain 5 is shown connected to S hook 4 at one end, to secure double loop chain 5, to an overhead structure, such as ceiling joist 3 illustrated here. S hook 6 is used to connect double loop chain 5 to eyebolt 8 of the "Horizontal Wire Feeder". By pulling end of wire 15 from outer layer of coil 15, which has been placed on frame 1 and 2, after frame 1 and 2 have been attached together, by 8 rivets 16, double loop chain 5 will become in a fixed position, after two or three complete rotations of frame 1 and 2 of "Horizontal Wire Feeder" and will then cause eyebolt 8 to also stay in a fixed position. This will allow frame 1 and 2 to rotate freely, in a horizontal fashion, and wire 15 will unroll evenly without curling or kinking.

The "Horizontal Wire Feeder" is comprised of frame 1 and 2, and an eyebolt 8, with eyebolt 8 being placed through an opening 7, of greater diameter then eyebolt 8, in the center of the top of the frame 1 and 2, with eye of bolt 8 being left extended above top of frame 1 and 2, and protruding out thru an opening 14, of greater diameter than eyebolt 8, in the center of the bottom of frame 1 and 2.

Other parts of the "Horizontal Wire Feeder" include flat washer 9, hitchpin 10, flat washer 12, self-locking nut 13, and rivets 16. Flat washer 9 encircles eyebolt 8 just inside opening 7, of the top of frame 1 and 2, and hitchpin 10 penetrates eyebolt 8, through a hole 11 drilled in eyebolt 8, just below flat washer 9. Flat washer 12, and self-locking nut 13, secure bottom of eyebolt 8, where it extends through opening 14, in the center of the bottom of frame 1 and 2, causing weight of coil 15 of wire 15, to be equally distributed, on frame 1 and 2, eyebolt 8, flat washer 9, hitchpin 10, flat washer 12, and self-locking nut 13.

Frame 1 and 2 is made of 16 gauge plated sheet metal, with frame 1 measuring 4"×34", and bent at four 90° angles. Starting at one end of flat frame 1 measure over 8" horizontally make a 90° bend, from that bend measure vertically 7" make a 90° bend, from that bend measure 4" horizontally make a 90° bend, from that bend measure 7" vertically, make a 90° bend, leaving 8" horizontally, at other end of frame 1. Place eight rivets 16 in frame 1 at both 8" horizontal sides, four rivets on each side placed uniformly, and penetrating flat 4"×20" frame 2, where frame 1 and frame 2 come together. When they have been attached, there will be four corners 17. These corners 17 will be cut at 45° angles. Coil 15 of wire 15 lays on the two 8" horizontal sides of frame 1 and 2, encircling the two 7" vertical sides of frame 1 and 2.

Although one detailed embodiment of the invention is illustrated in the drawings and previously described in detail, this invention contemplates any configuration, design, and relationship of components, which will function in a similar manner and which will provide equivalent results.

We claim:

1. A Horizontal wire feeder for unrolling a coil of wire comprising:

a frame having a top and a bottom spaced from the top, said top and said bottom each having a centered opening, said openings being vertically aligned with one another;

an eyebolt having a lengthened bolt portion which extends in a rotatable manner through the openings in the top and bottom, the eye of the eyebolt being positioned above the top of the frame, said bolt portion having a diameter smaller than the diameter of the openings;

said top being supported on a first flat washer which is mounted around the bolt portion and supported on a hitchpin attached to the bolt portion;

said bottom being supported on a second flat washer which is mounted around the bolt portion extending below the bottom and which is supported on a self locking nut;

a double loop chain attached at one end to a structure above the frame and attached at the other end to the eye of the eyebolt by a connecting device.

2. A horizontal wire feeder as in claim 1 wherein said first flat washer is positioned below the opening in the top of the frame and the hitchpin is supported in a hole in the bolt portion and below the first flat washer.

3. A horizontal wire feeder as in claim 1 wherein the frame is made of plated sheet metal and consists of an upper piece of frame bent at four 90 degrees angles to form an inverted U-shape attached to a flat bottom piece by attaching means.

* * * * *